US008109482B2

(12) United States Patent
Oh

(10) Patent No.: US 8,109,482 B2
(45) Date of Patent: Feb. 7, 2012

(54) SPRINKLER MOUNTING DEVICE

(75) Inventor: Seung-il Oh, Seoul (KR)

(73) Assignee: Kofulso Co., Ltd., Incheon-si (KR)

( * ) Notice: Subject to any disclaimer, the term of this patent is extended or adjusted under 35 U.S.C. 154(b) by 129 days.

(21) Appl. No.: 12/654,661

(22) Filed: Dec. 29, 2009

(65) Prior Publication Data

US 2011/0155865 A1 Jun. 30, 2011

(51) Int. Cl.
*B42F 13/00* (2006.01)

(52) U.S. Cl. ..... 248/342; 248/343; 248/62; 52/506.06; 52/506.07

(58) Field of Classification Search ..... 248/342, 248/343, 62, 65, 175, 317; 52/220.6, 506.06, 52/506.07, 506.08, 712, 715; 169/16, 37, 169/43; 24/295
See application file for complete search history.

(56) References Cited

U.S. PATENT DOCUMENTS

| | | | | |
|---|---|---|---|---|
| 3,608,857 | A | 9/1971 | Hibbeler | 248/317 |
| 3,612,461 | A | 10/1971 | Brown | 248/317 |
| 3,652,780 | A | 3/1972 | Wilson | 248/72 |
| 3,874,035 | A | 4/1975 | Schuplin | 248/72 |
| 4,135,692 | A | 1/1979 | Ferguson | 248/317 |
| 4,717,099 | A | 1/1988 | Hubbard | 248/57 |
| 4,723,749 | A | 2/1988 | Carraro et al. | 248/317 |
| 5,595,363 | A | 1/1997 | DeLeebeeck | 248/72 |
| 5,667,181 | A | 9/1997 | van Leeuwen et al. | 248/343 |
| 6,260,810 | B1 * | 7/2001 | Choi | 248/65 |
| 6,345,800 | B1 | 2/2002 | Herst et al. | 248/342 |
| 6,554,231 | B2 | 4/2003 | Choi | 248/65 |
| 6,811,130 | B1 | 11/2004 | Oh | 248/343 |
| 7,240,884 | B2 * | 7/2007 | Shim | 248/342 |
| 7,255,315 | B2 * | 8/2007 | Oh | 248/342 |
| 7,264,214 | B2 * | 9/2007 | Oh | 248/342 |
| 7,427,051 | B2 * | 9/2008 | Oh | 248/73 |
| 7,506,845 | B2 * | 3/2009 | Oh | 248/73 |
| 7,735,787 | B2 * | 6/2010 | Kafenshtok et al. | 248/75 |
| 7,784,746 | B2 * | 8/2010 | Kafenshtok et al. | 248/75 |
| 7,845,599 | B2 * | 12/2010 | Jackson | 248/73 |
| 7,878,464 | B2 * | 2/2011 | Oh | 248/65 |
| 7,954,771 | B2 * | 6/2011 | Paulig | 248/72 |
| 2010/0237201 | A1 * | 9/2010 | Oh | 248/74.2 |
| 2011/0154755 | A1 * | 6/2011 | Oh | 52/220.8 |

* cited by examiner

*Primary Examiner* — Nkeisha Smith
(74) *Attorney, Agent, or Firm* — Jacobson Holman PLLC

(57) ABSTRACT

A sprinkler mounting device that support units are joined to T-shaped frames and a support bar through screws, thereby providing a strong and firm mounted state and preventing a separation of the support units from the support bar during work.

5 Claims, 8 Drawing Sheets

SPRINKLER MOUNTING DEVICE

BACKGROUND OF THE INVENTION

1. Field of the Invention

The present invention relates to a sprinkler mounting device that support units are joined to T-shaped frames and a support bar through screws, thereby providing a strong and firm mounted state and preventing a separation of the support units from the support bar during work even though the mounting device is in an open type that a reducer is fit into a mounting bracket from the front.

2. Background Art

In general, as shown in FIG. 1, a sprinkler mounting device includes: a pair of T-shaped frames 1 mounted on a ceiling parallel with each other at a predetermined interval; a pair of support units 2 perpendicularly standing and joined to the T-shaped frames 1; a support bar 3 disposed on upper portions of the support units 2 in such a way as to cross the T-shaped frames 1; and a mounting bracket 4 mounted on the support bar 3 in a laterally movable manner, so that a reducer 5 is joined thereto.

Conventionally, the sprinkler mounting device is divided into two types: one being a separate type that the support bar 3 is separated from the support units 2; and the other being an integral type that bent portions, which serve the same role as the support units 2, are formed at both end portions of the support bar 3. Moreover, the mounting bracket 4 is divided into a closed type that the reducer 5 is perpendicularly and downwardly fit thereto and an open type that the reducer 5 fit the mounting bracket 4 from the front.

However, as shown in FIG. 1, the integral type mounting device that the support bar 3 is formed integrally with the support units 2 has a merit in that it provides a strong and firm joining structure, but a demerit in that a standardized rectangular pipe cannot be used as the support bar 3 differently from the separate type.

Furthermore, as shown in FIG. 2, the separate type mounting device that the support bar 3 and the support units 2 are manufactured in a separate form has several problems in that it is structurally weak since the support bar 3 and the T-shaped frames 1 are assembled to the support units 2 in a forcedly-fitting manner, and in that a user has to hold the mounting bracket 4 with one hand standing on a foothold since there is no a means for supporting the mounting bracket 4 during mounting work of the reducer 5 in case that the open type mounting bracket 4 to be fit to the support bar 3 is used.

SUMMARY OF THE INVENTION

Accordingly, the present invention has been made to solve the above-mentioned problems occurring in the prior arts, and it is an object of the present invention to provide a sprinkler mounting device, that can provide the same strong and firm joining structure as the integral type even though a rectangular-shaped pipe is used as a support bar since fastening screws fixed to support units by penetrating a support bar and T-shaped frames is used, and that can allow a user to easily perform mounting work of a reducer since a supporting means for supporting the support bar is additionally mounted on a mounting bracket, to which the reducer is fit from the front, and, which has an openable and closeable opening.

To accomplish the above object, according to the present invention, there is provided a sprinkler mounting device comprising: T-shaped frames each including a projecting jaw portion formed on an upper portion thereof and formed by a sidewall having a slot; support units, each including a vertical body, a horizontal plane portion bent to one side and formed at an upper portion of the vertical body, a first screw hole formed on the horizontal plane portion, a fastening screw joined to the support unit and the support bar through the first screw hole and having a tip portion penetrating the support bar, support portions projecting from the horizontal plane portion, a pressurizing member having both end portions, which are axially mounted to the support portions, the pressurizing member having pressure portions pressing the support bar when the pressurizing member is laid down, a rectangular hole formed beneath the horizontal plane portion for allowing an insertion of the support bar, an elastic member having upper portions hingedly joined to a central portion of the vertical body and a bent portion formed on a lower portion thereof to clamp a lower end of the projecting jaw portion, a joining portion formed on a lower portion of the vertical body for fixing the projecting jaw portion thereinto, a second screw hole formed on the joining portion, and a fastening screw joined to the support unit and the T-shaped frame through the second screw hole and having a sharp tip portion penetrating the projecting jaw portion; a support bar with a rectangular section, whose both end portions are fit into the rectangular holes of the support units, the support bar crossing the T-shaped frames; and a mounting bracket including a body having a mounting portion for fitting the reducer thereto from the front, a rotating member having one side axially mounted on the front of the body for opening and closing the mounting portion and the other side having a groove, a fastening member to which the groove is fit, restricting jaw portions formed on both sides of the rear part of the mounting portion in such a way as to be bent upwardly for supporting the support bar, a first tightening screw mounted on an upper portion of the rear part of the body for tightening the support bar, and a second tightening screw joined to the center of the rotating member for closely contacting the reducer to the support bar.

As described above, the sprinkler mounting device according to the present invention can achieve the same strong and firm joining structure as the integral type support bar even though the mounting device is in the separate type that the standardized rectangular pipe is used as the support bar since the tip portions of the fastening screws penetrate and fasten the support bar and the T-shaped frames when the fastening screws are tightened in a state where the support bar and the T-shaped frames are joined to the support units by the elastic member and the pressurizing member. Furthermore, the present invention can provide a user with an easy mounting work of the reducer since the mounting bracket is fixed by the first tightening screw and the restricting jaw portion and there is no need for the user to hold the mounting bracket with the hand when the reducer is mounted on the mounting portion.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will be now made in detail to the preferred embodiment of the present invention with reference to the attached drawings.

Figure 3:
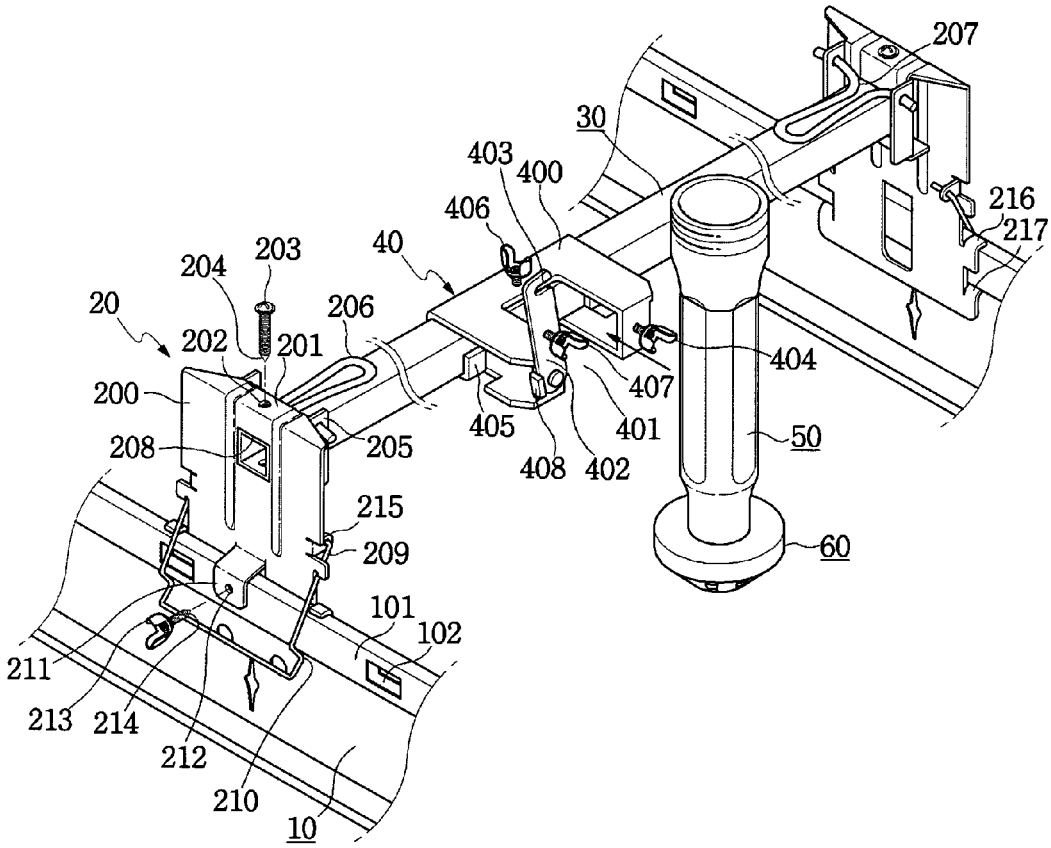
FIG. 3 is a perspective view of a sprinkler mounting device according to the present invention.

As shown in FIG. 3, a sprinkler mounting device includes: a pair of T-shaped frames 10 mounted on a ceiling parallel with each other at a predetermined interval; a pair of support units 20 perpendicularly standing and joined to the T-shaped frames 10; a support bar 30 disposed on upper portions of the support units 20 in such a way as to cross the T-shaped frames 10; and a mounting bracket 40 mounted on the support bar 30 in a laterally movable manner, so that a reducer 50 is joined thereto.

Figure 1:
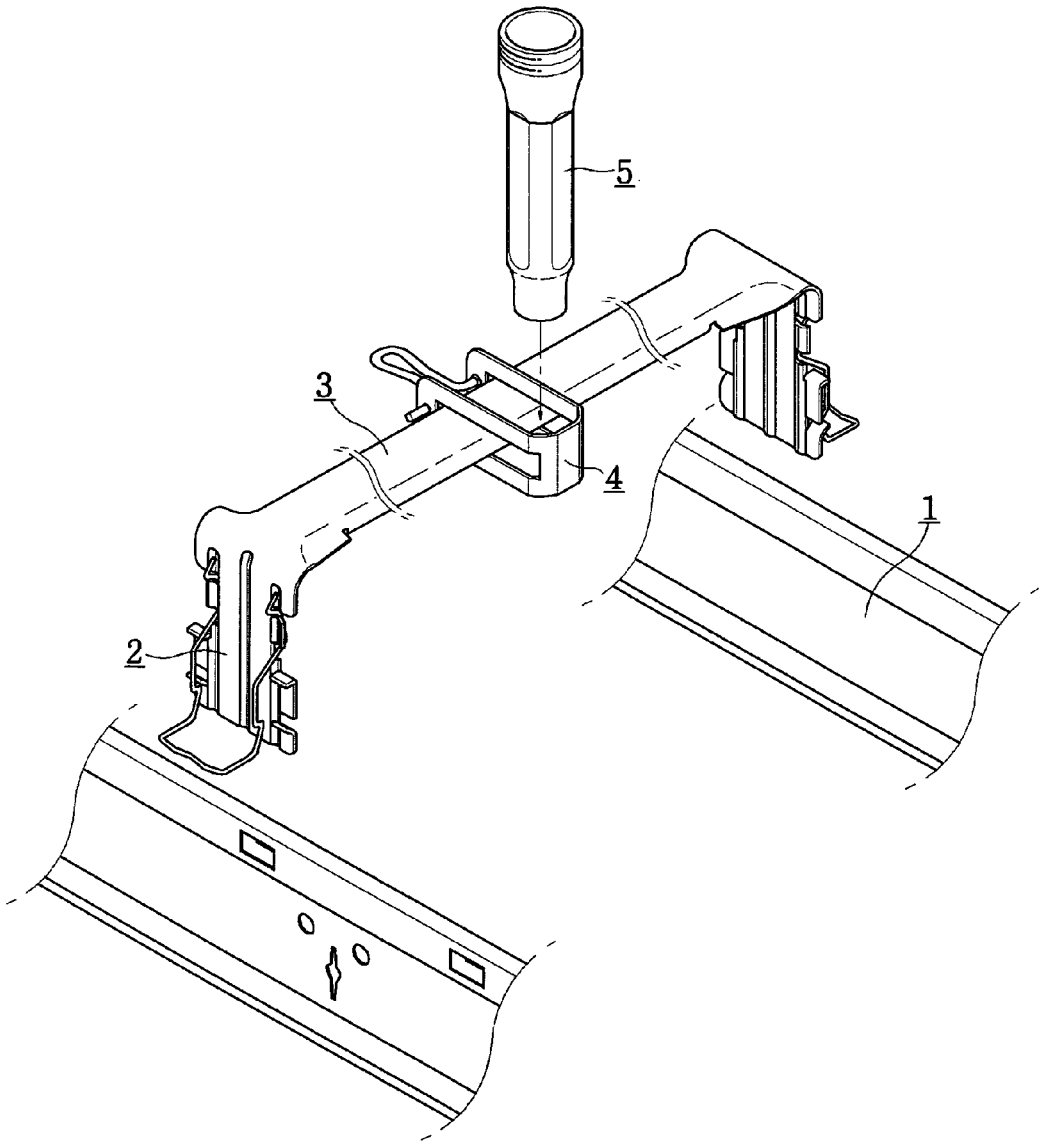
FIG. 1 PRIOR ART
FIG. 1 is a perspective view of a conventional sprinkler mounting device that a support bar and support units are formed integrally.
Figure 2:
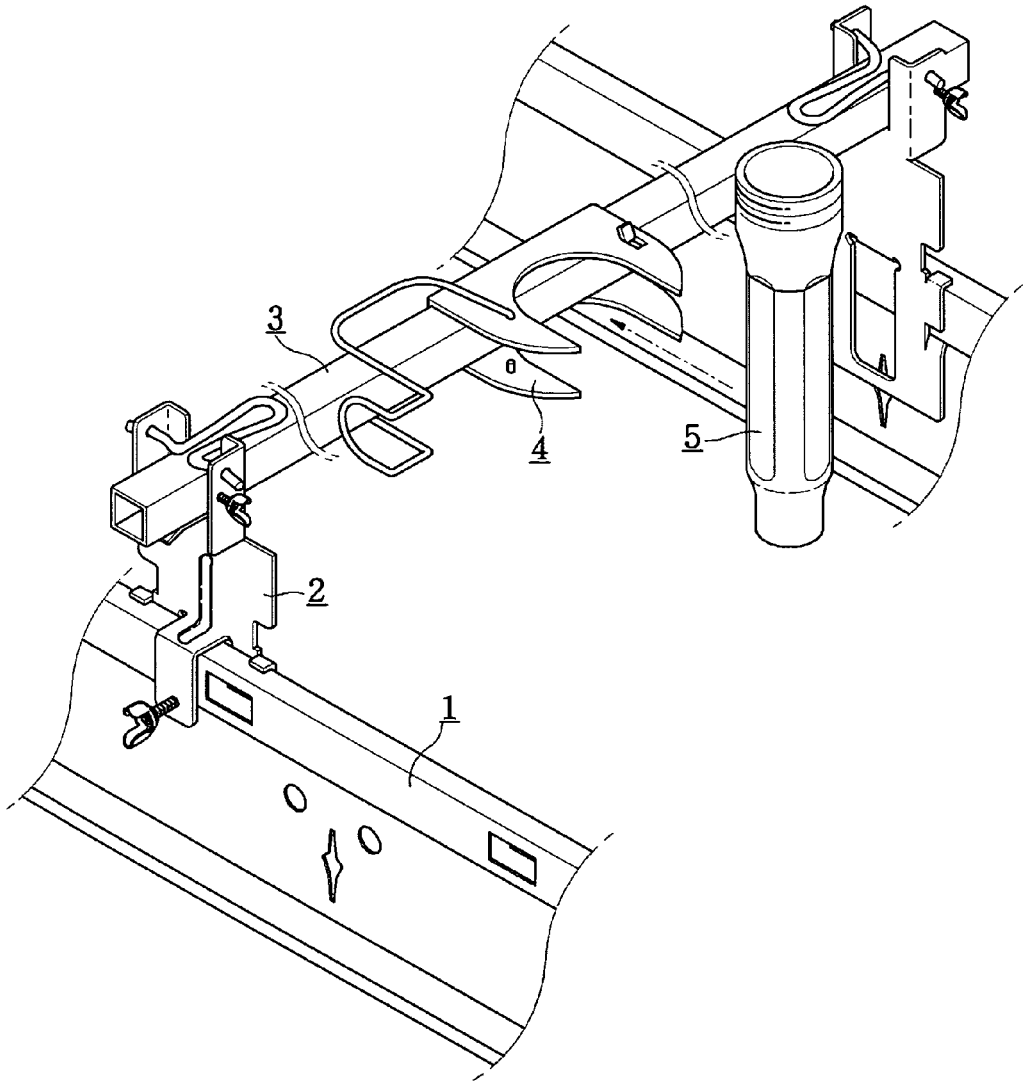
FIG. 2 PRIOR ART
FIG. 2 is a perspective view of another conventional sprinkler mounting device that a support bar and support units are formed separately.

Each of the T-shaped frames 10 includes a projecting jaw portion 101 formed on an upper portion thereof and formed by an one-ply sidewall having a slot 102, and is unfit for joining the support unit 20 thereto using a fastening screw 213 having a sharp tip portion 214 since a lower portion of the projecting jaw portion 101 is relatively weak. For this reason, typically, a blunt-ended tightening screw is mounted to a lower end of the projecting jaw portion 101 in such a way as to be caught to the lower end of the projecting jaw portion 101, so that a joining portion 211 is not separated from the projecting jaw portion 101. (See FIG. 1)

Figure 4:
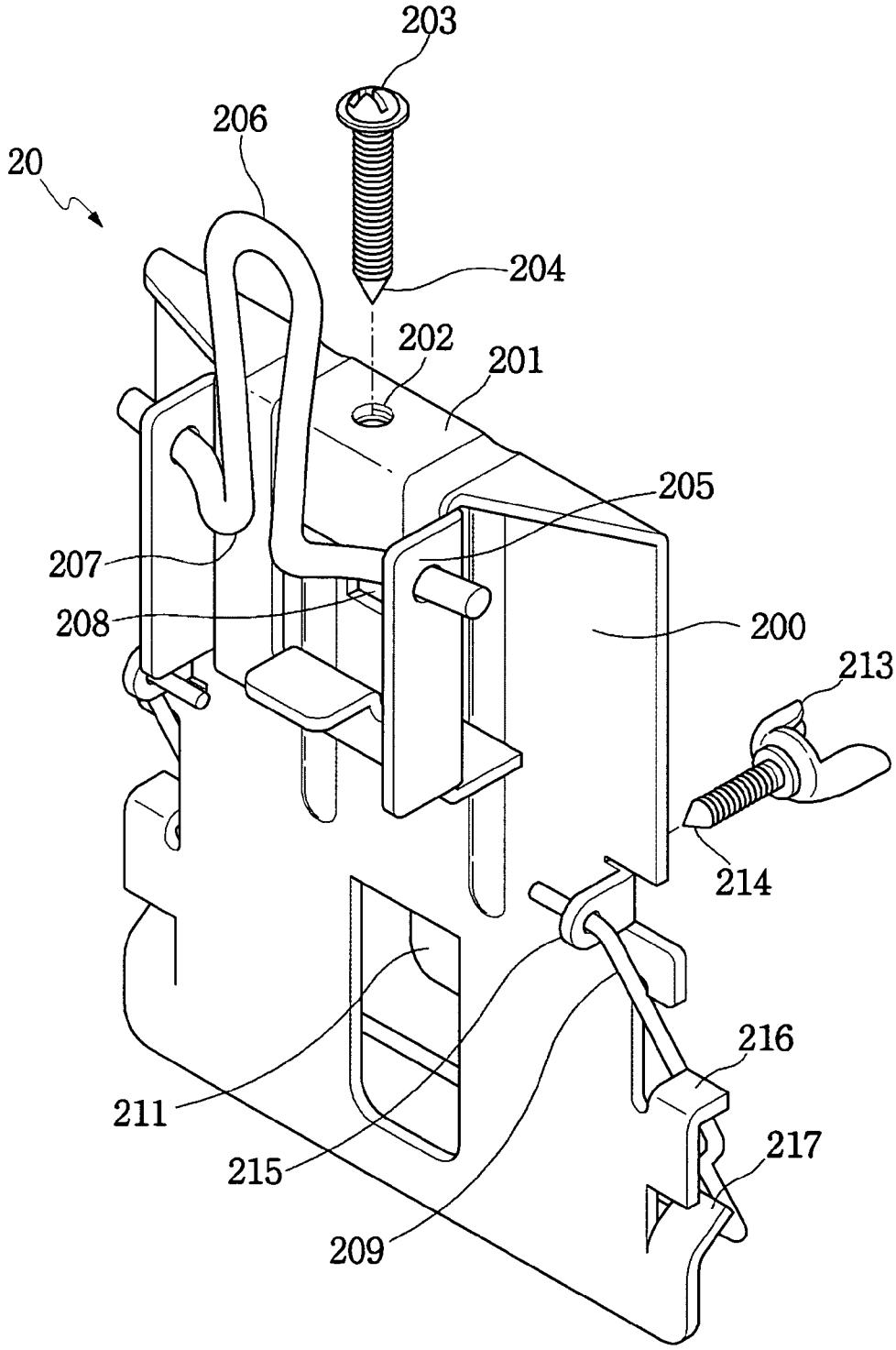
FIG. 4 is a sectional view of a mounting bracket of the present invention.

As shown in FIGS. 3 and 4, each of the support units 20 includes: a vertical body 200; a horizontal plane portion 201 bent to one side and formed at an upper portion of the vertical body 200; a first screw hole 202 formed on the horizontal plane portion 201; a fastening screw 203 joined to the support unit 20 and the support bar 30 through the first screw hole 202 and having a tip portion 204 penetrating the support bar 30; support portions 205 projecting from the horizontal plane portion 201; a pressurizing member 206 having both end portions, which are axially mounted to the support portions 205, the pressurizing member 206 having pressure portions 207 pressing the support bar 30 when the pressurizing member 206 is laid down; a rectangular hole 208 formed beneath the horizontal plane portion 201 for allowing an insertion of the support bar 30; an elastic member 209 having upper portions hingedly joined to a central portion of the vertical body 200 and a bent portion 210 formed on a lower portion thereof to clamp a lower end of the projecting jaw portion 101; a joining portion 211 formed on a lower portion of the vertical body 200 for fixing the projecting jaw portion 101 thereinto; a second screw hole 212 formed on the joining portion 211; and the fastening screw 213 joined to the support unit 20 and the T-shaped frame 10 through the second screw hole 212 and having the sharp tip portion 214 penetrating the projecting jaw portion 101. The vertical body 200 includes: hinge portions 215 formed at both sides of the center thereof for rotatably joining both ends of the elastic member 209; a retaining portion 216 put on an upper end of the projecting jaw portion 101; and an inclined retaining portion 217 put on a lower end of the projecting jaw portion 101.

The support bar 30 is a standardized pipe with a rectangular section, which is cut according to an interval of the support units 20 mounted on the T-shaped frames 10.

Figure 5:
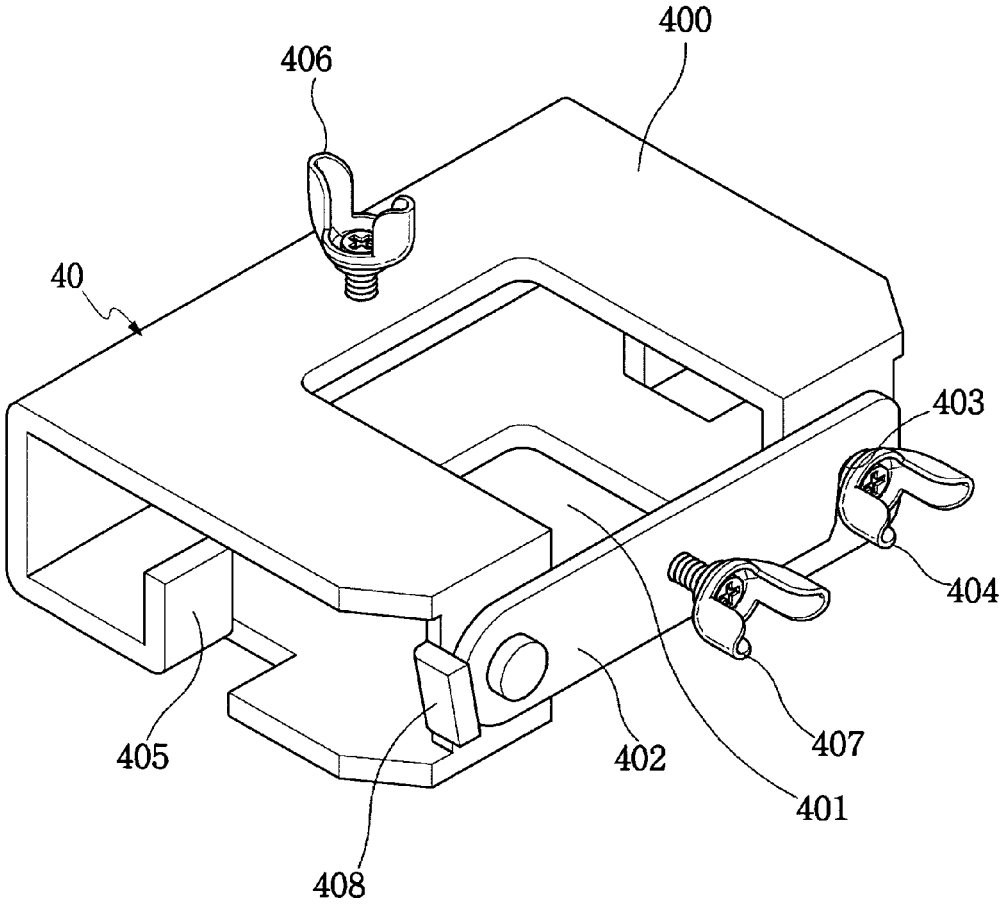
FIG. 5 is a sectional view of support units of the present invention.

As shown in FIGS. 3 and 5, the mounting bracket 40 includes: a body 400 having a mounting portion 401 for fitting the reducer 50 thereto from the front; a rotating member 402 having one side axially mounted on the front of the body 400 for opening and closing the mounting portion 401 and the other side having a groove 403; a fastening member 404 to which the groove 403 is fit; restricting jaw portions 405 formed on both sides of the rear part of the mounting portion 401 in such a way as to be bent upwardly for supporting the support bar 30; a first tightening screw 406 mounted on an upper portion of the rear part of the body 400 for tightening the support bar 30; and a second tightening screw 407 joined to the center of the rotating member 402 for closely contacting the reducer 50 to the support bar 30. The body 400 includes a projecting portion 408 formed on one side of the front part thereof for supporting a standing state of the rotating member 402. The fastening member 404 may be a tightening screw for tightening the rotating member 402 to the body 400 in a state where the groove 403 is fit thereto.

Figure 6:
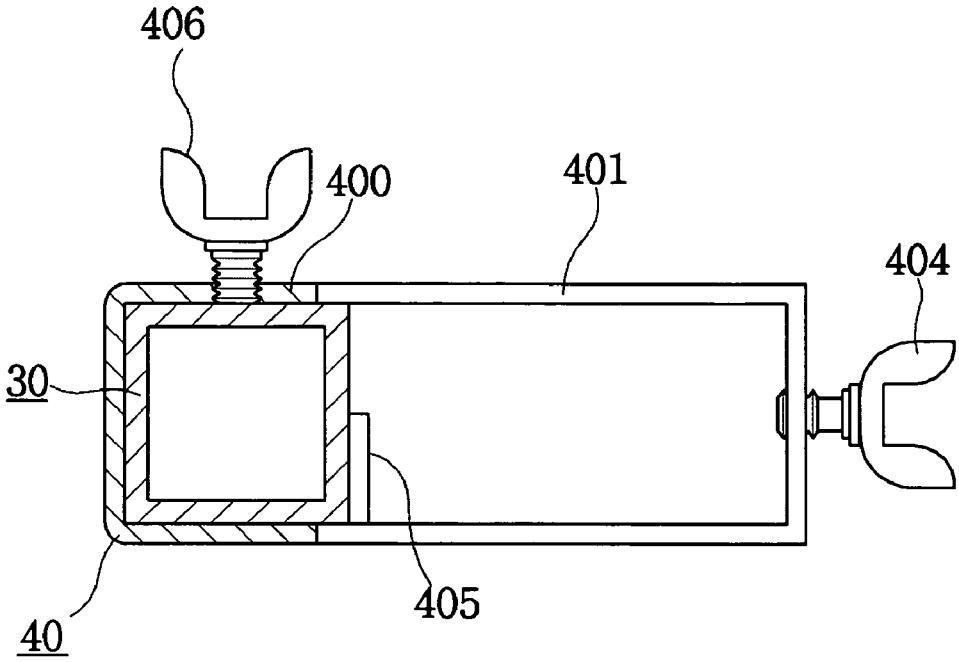
FIG. 6 is a sectional view showing a state where the mounting bracket is joined to the support bar according to the present invention.

As described above, as shown in FIG. 6, the support bar 30 is inserted into the rear part of the mounting bracket 40 in such a way as to be supported by the restricting jaw portions 405 in back and forth directions, and then, the first tightening screw 406 tightens and fixes the support bar 30 to the mounting bracket 40.

When the pressurizing member 206 axially mounted on the support portions 205 is rotated after both sides of the support bar 30, to which the mounting bracket 40 is joined, are inserted into the rectangular holes 208 of the support units 20, the pressure portion 207 presses and fixes the support bar 30. After that, when the fastening screw 203 of the first screw hole 202 is tightened in such a way as to penetrate and fasten the support bar 30 in order to integrate the support bar 30 and the support units 20 with each other.

Figure 7:
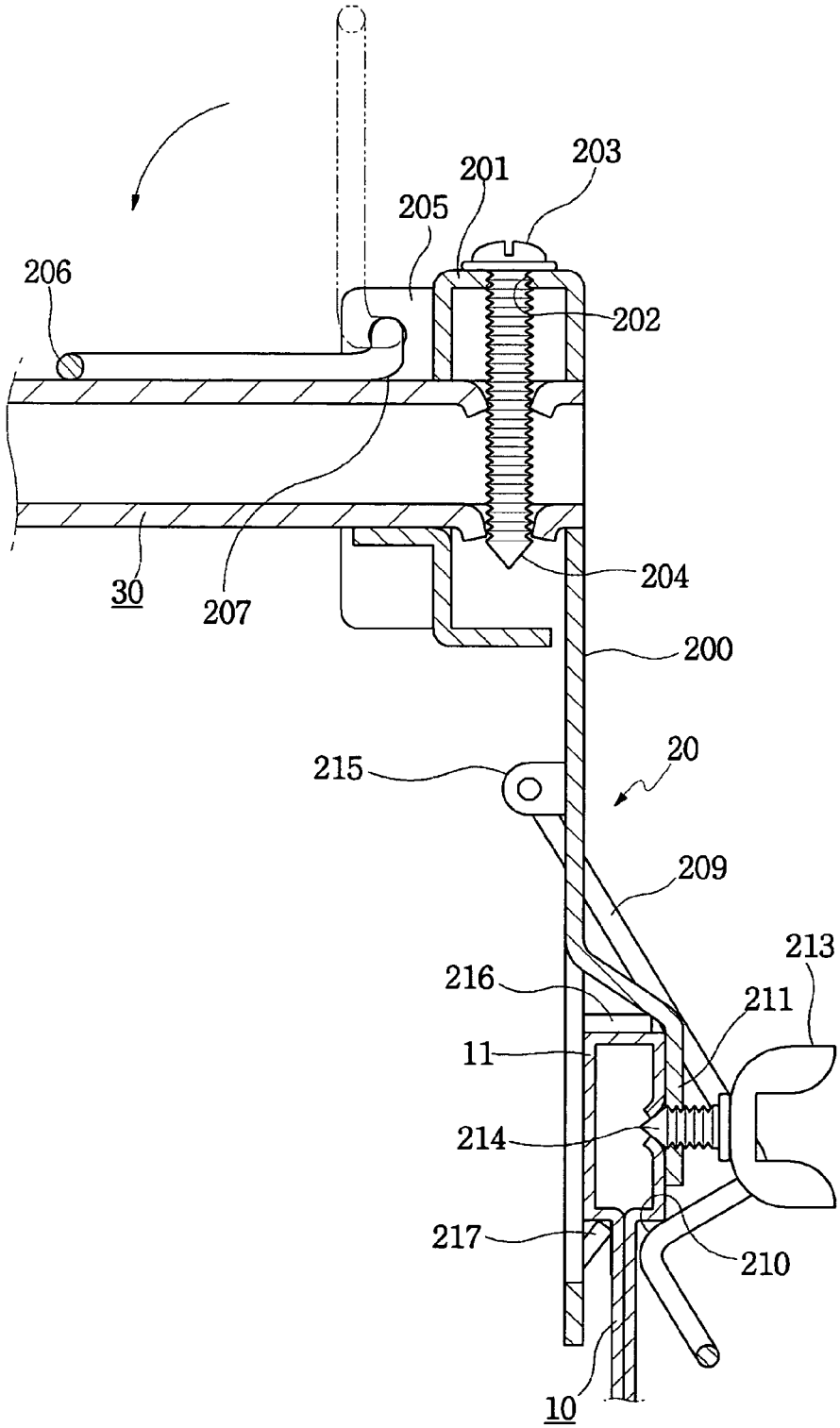
FIG. 7 is a sectional view showing a joined state of the support units according to the present invention.

When the joining portion 211 of each support unit 20 is fit to the projecting jaw portion 101 of each T-shaped frame 10, the lower end of the projecting jaw portion 101 is supported by the bent portion 210 of the elastic member 209 and the inclined retaining portion 217, and the upper end of the projecting jaw portion 101 is supported by the retaining portion 216. In the above state, when the fastening screw 213 of the second screw hole 212 is tightened in such a way that the tip portion 214 penetrates the projecting jaw portion 101 in order to integrate the support unit 20 and the T-shaped frame 10 with each other, as shown in FIG. 7, The T-shaped frame 10 and the support bar 30 are mounted integrally to the support unit 20 by the fastening screws 203 and 213.

Figure 8:
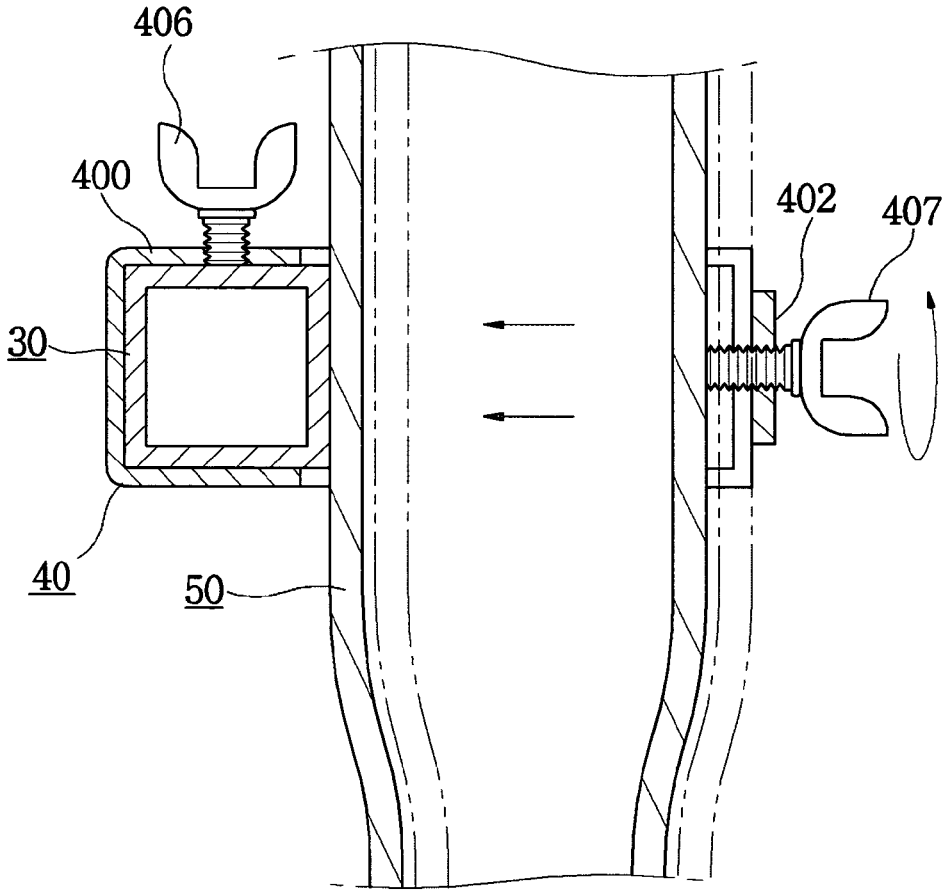
FIG. 8 is a sectional view showing a state where a reducer is joined to the mounting bracket according to the present invention.

In a state where the T-shaped frame 10 and the support bar 30 respectively integrated to the support unit 20 are mounted on a ceiling, the reducer 50 having a head 60 is pushed into the mounting portion 401, and then, the rotating member 402 is rotated until the groove 403 is caught to the fastening member 404 and an entrance of the mounting portion 401 is closed. After that, in the state where the entrance of the mounting portion 401 is closed, when the second tightening screw 407 is tightened, as shown in FIG. 8, the reducer 50 is mounted and fixed in a state where it is in a close contact with the support bar 30, whereby mounting work of a sprinkler is finished.

By conducting work to mount the reducer 50 to the mounting bracket 40 standing on a foothold and work to integrate the T-shaped frame 10 and the support bar 30 with the support units 20 on the floor, a user can rapidly and conveniently perform mounting work of the sprinkler.

As described above, the sprinkler mounting device according to the present invention can achieve the same strong and firm joining structure as the integral type support bar even though the mounting device is in the separate type that the standardized rectangular pipe is used as the support bar 30 since the tip portions 204 and 214 of the fastening screws 203 and 213 penetrate and fasten the support bar 30 and the T-shaped frames 10 when the fastening screws 203 and 213 are tightened in a state where the support bar 30 and the T-shaped frames 10 are joined to the support units 20 by the elastic member 209 and the pressurizing member 206. Furthermore, the present invention can provide the user with an easy mounting work of the reducer 50 since the mounting bracket 40 is fixed by the first tightening screw 406 and the restricting jaw portion 405 and there is no need for the user to hold the mounting bracket 40 with the hand when the reducer 50 is mounted on the mounting portion 401.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A sprinkler mounting device comprising:

T-shaped frames each including a projecting jaw portion formed on an upper portion thereof and formed by a sidewall having a slot;

support units, each including: a vertical body; a horizontal plane portion bent to one side and formed at an upper portion of the vertical body; a first screw hole formed on the horizontal plane portion; a fastening screw joined to the support unit and a support bar through the first screw hole and having a tip portion penetrating the support bar; support portions projecting from the horizontal plane portion; a pressurizing member having both end portions, which are axially mounted to the support portions, the pressurizing member having pressure portions pressing the support bar when the pressurizing member is laid down; a rectangular hole formed beneath the horizontal plane portion for allowing an insertion of the support bar; an elastic member having upper portions hingedly joined to a central portion of the vertical body and a bent portion formed on a lower portion thereof to clamp a lower end of the projecting jaw portion; a joining portion formed on a lower portion of the vertical body for fixing the projecting jaw portion thereinto; a second screw hole formed on the joining portion; and a fastening screw joined to the support unit and the T-shaped frame through the second screw hole and having a sharp tip portion penetrating the projecting jaw portion;

the support bar being of a rectangular section, whose both end portions are fit into the rectangular holes of the support units, the support bar crossing the T-shaped frames; and a mounting bracket including: a body having a mounting portion for fitting a reducer thereto from a front; a rotating member having one side axially mounted on the front of the body for opening and closing the mounting portion and an other side having a groove; a fastening member to which the groove is fit; restricting jaw portions formed on both sides of a rear part of the mounting portion in such a way as to be bent upwardly for supporting the support bar; a first tightening screw mounted on an upper portion of a rear part of the body for tightening the support bar; and a second tightening screw joined to a center of the rotating member for closely contacting the reducer to the support bar.

2. The sprinkler mounting device according to claim 1, wherein the vertical body comprises: hinge portions formed at both sides of a center thereof for rotatably joining both ends of the elastic member; a retaining portion put on an upper end of the projecting jaw portion; and an inclined retaining portion put on a lower end of the projecting jaw portion.

3. The sprinkler mounting device according to claim 1, wherein the support bar is a pipe with a rectangular section, which is cut according to an interval of the support units mounted on the T-shaped frames.

4. The sprinkler mounting device according to claim 1, wherein the body of the mounting bracket includes a projecting portion formed on one side of a front part thereof for supporting a standing state of the rotating member.

5. The sprinkler mounting device according to claim 1, wherein the fastening member is a tightening screw for tightening the rotating member to the body in a state where the groove is fit thereto.

* * * * *